US011421637B2

(12) United States Patent
Shaull et al.

(10) Patent No.: US 11,421,637 B2
(45) Date of Patent: Aug. 23, 2022

(54) HIGH PRESSURE DIESEL FUEL PUMP PUMPING ELEMENT

(71) Applicant: CUMMINS INC., Columbus, IN (US)

(72) Inventors: Anthony A. Shaull, Columbus, IN (US); Tunji Adejumo, Columbus, IN (US); Luke Allen Jones, Columbus, IN (US); Yip Kwok, Indianapolis, IN (US); John D. Lane, Columbus, IN (US); David M. Rix, Columbus, IN (US); Wesley R. Thayer, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 30 days.

(21) Appl. No.: 15/539,588

(22) PCT Filed: Dec. 15, 2015

(86) PCT No.: PCT/US2015/065843

§ 371 (c)(1),
(2) Date: Jun. 23, 2017

(87) PCT Pub. No.: WO2016/111814

PCT Pub. Date: Jul. 14, 2016

(65) Prior Publication Data

US 2018/0156175 A1 Jun. 7, 2018

Related U.S. Application Data

(60) Provisional application No. 62/099,893, filed on Jan. 5, 2015.

(51) Int. Cl.
*F04B 53/10* (2006.01)
*F02M 59/46* (2006.01)
(Continued)

(52) U.S. Cl.
CPC ..... *F02M 59/464* (2013.01); *F02M 59/025* (2013.01); *F04B 7/0266* (2013.01); *F04B 53/109* (2013.01); *F04B 53/14* (2013.01)

(58) Field of Classification Search
CPC ..... F04B 7/0266; F04B 53/109; F04B 53/14; F04B 53/10; F02M 59/464; F02M 59/025;
(Continued)

(56) References Cited

U.S. PATENT DOCUMENTS 2,932,312 A * 4/1960 Roeder ..... F04B 53/109 137/332
3,194,174 A * 7/1965 Coberly ..... F04B 17/05 184/6.28
(Continued)

FOREIGN PATENT DOCUMENTS

CN 203532126 U * 4/2014 ..... F03M 59/46
DE 3532728 3/1987
(Continued)

OTHER PUBLICATIONS

Machine Translation of Chinese Patent document CN 203532126 U to Zhang, M. published on Apr. 9, 2014.*
(Continued)

*Primary Examiner* — Essama Omgba
*Assistant Examiner* — Dnyanesh G Kasture
(74) *Attorney, Agent, or Firm* — Faegre, Drinker, Biddle & Reath, LLP

(57) ABSTRACT

The present disclosure generally relates to a pumping element of a fuel pump for an internal combustion engine wherein the pumping element comprises a pumping chamber and a check valve assembly having a first insert including an angled passage in flow communication with a fuel outlet, and a second insert being disposed adjacent the
(Continued)

pumping chamber, the second insert including a central bore in flow communication with a fuel inlet, a plurality of through holes in flow communication with the pumping chamber.

24 Claims, 4 Drawing Sheets

(51) Int. Cl.
*F02M 59/02* (2006.01)
*F04B 7/02* (2006.01)
*F04B 53/14* (2006.01)

(58) Field of Classification Search
CPC ..... F02M 59/367; F02M 63/0054; F02M 57/026; Y10T 137/7841; Y10T 137/7842; Y10T 137/7914; Y10T 137/7938; F16K 15/025; F16K 15/021; F16K 15/023; F16K 15/066; F16K 2200/204
See application file for complete search history.

(56) References Cited

U.S. PATENT DOCUMENTS 3,206,110 A * 9/1965 Waibel ..... F04B 39/1033 417/564
3,338,172 A * 8/1967 Hafele ..... F02M 37/043 417/549
3,357,363 A 12/1967 Raymond
3,811,801 A 5/1974 Buse et al.
4,516,606 A * 5/1985 Worley ..... F15D 1/0005 137/625.3
4,551,077 A * 11/1985 Pacht ..... F04B 53/1022 417/454
5,362,216 A * 11/1994 Hammelmann ..... F04B 53/007 137/512.3
5,605,449 A * 2/1997 Reed ..... F04B 53/1022 137/454.4
6,358,024 B1 3/2002 Djordjevic
6,637,410 B2 10/2003 Onishi et al.
6,648,610 B2 11/2003 Williams
6,769,413 B2 8/2004 Ishimoto
6,889,662 B2 5/2005 Hess
6,948,513 B2 * 9/2005 Steerman ..... B60S 1/52 137/15.18
7,096,856 B2 8/2006 Fukuhara et al.
7,350,505 B2 4/2008 Felton
7,677,872 B2 3/2010 Beardmore
8,061,328 B2 11/2011 Shafer et al.
8,272,856 B2 * 9/2012 Fuchs ..... F02M 59/464 417/451
2009/0194717 A1 * 8/2009 Jarchau ..... F04B 1/0452 251/12
2013/0022484 A1 1/2013 Fuchs et al.
2014/0193281 A1 7/2014 Shaull et al.
2015/0211641 A1 * 7/2015 Pacht ..... F16K 1/42 251/359

FOREIGN PATENT DOCUMENTS

GB 790570 2/1958
JP 5430546 B2 * 3/2014 ..... F04B 53/1007
WO 2008/105387 4/2008
WO 2014/183907 11/2014

OTHER PUBLICATIONS

Machine Translation of JP 5430546 B2 retrieved from espacenet on Mar. 3, 2022 (Year: 2022).*
Examination report issued by The State Intellectual Property Office of China (Chinese language), dated Jul. 30, 2018, for related Application No. CN201580072153 X; 8 pages.
Examination report issued by The State Intellectual Property Office of China (translated to English language), dated Jul. 30, 2018, for related Application No. CN201580072153.X; 11 pages.
International Search Report and Written Opinion dated Feb. 19, 2016 in PCT/US2015/065843.
International Preliminary Reporton Patentability received for PCT Patent Application No. PCT/US2015/065843, dated Jul. 20, 2017, 6 pages.
First Examination Report issued by the Indian Patent: Office for Indian patent application No. 201717022000, dated Oct. 21, 2020, 6 pages, with English translation.

* cited by examiner

HIGH PRESSURE DIESEL FUEL PUMP PUMPING ELEMENT

RELATED APPLICATIONS

The present application is a national phase filing under 35 U.S.C. § 371 of International Application No. PCT/US2015/065843, titled "HIGH PRESSURE DIESEL FUEL PUMP PUMPING ELEMENT," filed on Dec. 15, 2015, which claims the benefit of Provisional Application No. 62/099,893, filed Jan. 5, 2015 with the U.S. Patent and Trademark Office, the entire disclosures of which being expressly incorporated herein by reference.

FIELD OF THE DISCLOSURE

The present disclosure generally relates to a pumping element of a fuel pump for an internal combustion engine. More specifically, this disclosure relates to check valves for a pumping element of a fuel pump that permit fuel to enter and exit the pumping element.

BACKGROUND OF THE DISCLOSURE

Fuel pumps typically include pumping elements that comprise a pumping plunger reciprocating within a bore. The pumping plunger's reciprocating motion is typically accomplished with a mechanism that moves the plunger with a rotating cam. The pumping element typically includes a plurality of other components that cooperate with the pumping plunger to pressurize a flow of fluid, typically oil or fuel, for use in an internal combustion engine. For example, a fuel injector might use the flow of pressurized fuel from the fuel pump to inject the fuel or to intensify the pressure of the fuel that is injected into the engine.

Additionally, pumping elements are typically associated with valves to permit fuel flow into the pumping element and from the pumping element to one or more fuel injectors. One type of valve associated with a pumping element is an inlet check valve, which permits fuel to flow into a pumping chamber of the pumping element from a pressurized fuel supply line. Another type of valve associated with a pumping element is an outlet check valve, which permits highly pressurized fuel to flow from the pumping element to an accumulator, a fuel rail, or to one or more fuel injectors. These valves are positioned in a pumping element by way of complex components and assemblies.

Modern fuel systems use progressively higher injection pressures for injecting fuel within the combustion chamber of internal combustion engines. However, a variety of issues may arise when attempting to increase the service pressure of a fuel pump and its associated pumping element. For example, increased service pressure increases the thermal load imparted on the complex components that comprise the pumping element. Therefore, material and design challenges have a tendency to limit pump outlet pressures due to the enhanced stresses and thermal effects resulting from high service pressures. As such, a need exists for a pumping element having an improved check valve design that addresses current product design challenges, reduces manufacturing costs, and not only meets but exceeds product performance standards.

SUMMARY OF THE DISCLOSURE

In one embodiment of the present disclosure a pumping element is provided comprising a check valve having a first insert including at least one angled passage and a second insert including a central bore and an inlet check valve plunger disposed in the bore; and a pumping chamber wherein the second insert of the check valve is disposed adjacent the pumping chamber, the second insert including a plurality of through-holes configured to allow fuel to enter and exit the pumping chamber. In one aspect of this embodiment the second insert of the check valve includes a first end and a second end, wherein the central bore extends from the first end downwardly along a longitudinal axis of the check valve. In a variant of this aspect the plurality of through-holes extend from the second end and terminate at the central bore. In a variant of this variant each one of the plurality of through-holes includes a first diameter at the second end and a second diameter at the central bore, wherein the first diameter is greater than the second diameter. In another aspect of this embodiment, the central bore includes an annular shoulder and the plurality of through-holes are disposed radially inward of the annular shoulder. In a variant of this aspect the central bore includes an annular wall having a first diameter and the annular shoulder projects outwardly radially relative to the annular wall, wherein the outward radial projection of the annular shoulder forms a second diameter of the central bore that is greater than the first diameter. In yet another aspect of this embodiment the number of the plurality of through-holes is proportional to an amount of fuel entering and exiting the pumping chamber. In yet another aspect of this embodiment the inlet check valve plunger is reciprocally moveable in the central bore between an opened position and a closed position. In a variant of this aspect the central bore includes a first end and a second end, wherein the inlet check valve plunger in the opened position abuts the second end and in the closed position defines a stroke gap between the inlet check valve plunger and the second end wherein the stroke gap is at least 0.4 mm. In a variant of this variant the first insert includes a first end and a second end and, wherein the inlet check valve plunger in the closed position is in sealing engagement with the second end of the first insert, wherein the sealing engagement prevents fuel flow into the central bore and into the pumping chamber.

In another embodiment of the present disclosure a pumping element is provided comprising a body having an upper chamber, a lower chamber and at least one fuel inlet port disposed in the upper chamber; a first check valve body and a second check valve body, wherein the first and second check valve body are disposed in the upper chamber, and the first check valve body includes an outlet check valve plunger and at least one angled passage; an inlet check valve plunger disposed longitudinally in the upper chamber and a pumping plunger disposed longitudinally in the lower chamber, the inlet check valve plunger having an opened position and a closed position, wherein the opened position permits fuel from the at least one fuel inlet port to fill the lower chamber; and wherein the pumping plunger is reciprocally moveable in the lower chamber such that movement of the plumping plunger toward the upper chamber causes the inlet check valve plunger to move to the closed position and the outlet check valve permits fuel to exit the pumping element.

In one aspect of this embodiment, the inlet check valve plunger includes a central bore and a spring disposed therein, and the inlet check valve plunger moves to the closed position in response to a biasing force of the spring in cooperation with a reversal of fuel flow. In another aspect of this embodiment, a first fuel inlet port is disposed in the upper chamber and a second fuel inlet port is disposed in the first check valve body. In a variant of this aspect the first check valve body includes a first angled passage and a second angled passage wherein the first angled passage and the second angled passage converge, and the second fuel inlet port is disposed between the first angled passage and the second angled passage. In yet another aspect of this embodiment the first check valve body includes a first end and a second end, wherein the first end includes a central bore that receives the outlet check valve plunger and the second end includes an annular recess. In a variant of this aspect the second check valve body includes a first end and a second end, wherein the first end includes a central bore which receives the inlet check valve plunger, the central bore having an opening with an annular recess at the first end of the second check valve body. In a variant of this variant, the annular recess of the first check valve body and the annular recess of the second check valve body cooperate to form an annular passage between the first check valve body and the second check valve body. In yet another aspect of this embodiment the outlet check valve responds to movement of the pumping plunger toward the upper chamber by delivering fuel from the pumping element and movement of the pumping plunger away from the upper chamber by preventing delivery of fuel from the pumping element. In a variant of this aspect during fuel delivery by the pumping element, fuel travels from the lower chamber and through the first check valve body via the at least one angled passage. In yet another aspect of this embodiment, a head assembly mounted to the upper chamber wherein the head assembly includes a fuel outlet port configured to deliver fuel from the pumping element in response to the inlet check valve plunger being in the closed position. In a variant of this aspect the fuel outlet port is disposed at an angle relative to the upper chamber.

In yet another embodiment of the present disclosure a pumping element is provided comprising a pumping chamber; and a check valve assembly having a first insert including a passage in flow communication with a fuel outlet, and a second insert being disposed adjacent the pumping chamber, the second insert including a bore in flow communication with a fuel inlet, a plurality of through holes in flow communication with the pumping chamber, and an inlet check valve plunger disposed in the bore for movement between an opened position wherein fuel from the fuel inlet flows past the inlet check valve plunger through the plurality of through holes to the pumping chamber and a closed position wherein fuel from the pumping chamber flows through the plurality of through holes past the inlet check valve plunger to the passage of the first insert. In one aspect of this embodiment the inlet check valve plunger includes a central bore and a spring disposed therein, and the inlet check valve plunger moves to the closed position in response to a biasing force of the spring in cooperation with a reversal of fuel flow. In another aspect of this embodiment the bore includes a first end and a second end, wherein the inlet check valve plunger in the opened position abuts the second end and in the closed position defines a stroke gap between the inlet check valve plunger and the second end wherein the stroke gap is at least 0.4 mm. In yet another aspect of this embodiment the first insert includes a first end and a second end and, wherein the inlet check valve plunger in the closed position is in sealing engagement with the second end of the first insert, wherein the sealing engagement prevents fuel flow into the pumping chamber.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION OF EMBODIMENTS

The embodiments disclosed herein are not intended to be exhaustive or to limit the disclosure to the precise forms disclosed in the following detailed description. Rather, the embodiments were chosen and described so that others skilled in the art may utilize their teachings.

Figure 1B:
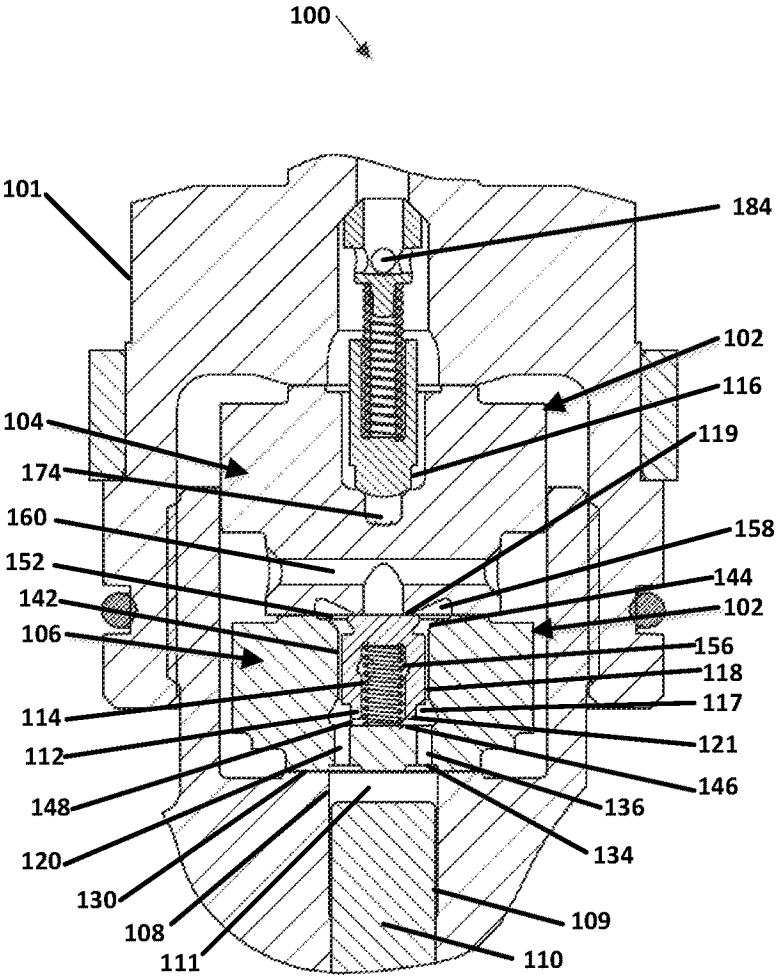
FIG. 1B is an enlarged cross-sectional view of a second plane of a pumping element according to the present disclosure.
Figure 1A:
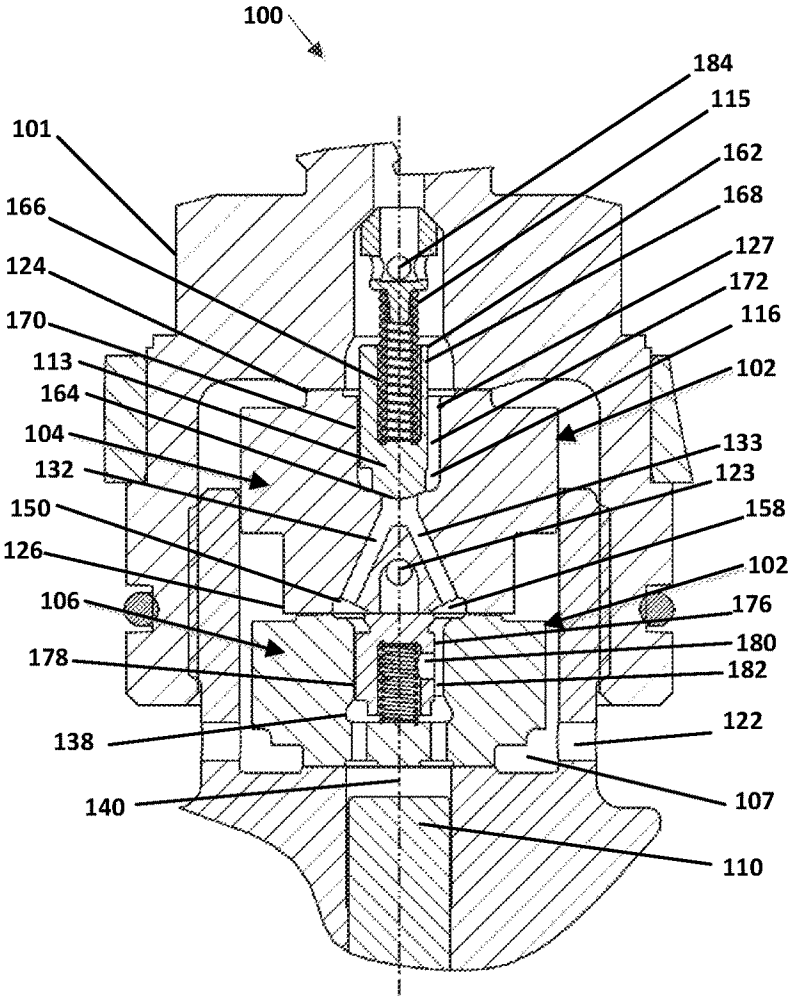
FIG. 1A is an enlarged cross-sectional view of a first plane of a pumping element according to the present disclosure.
Figure 2B:
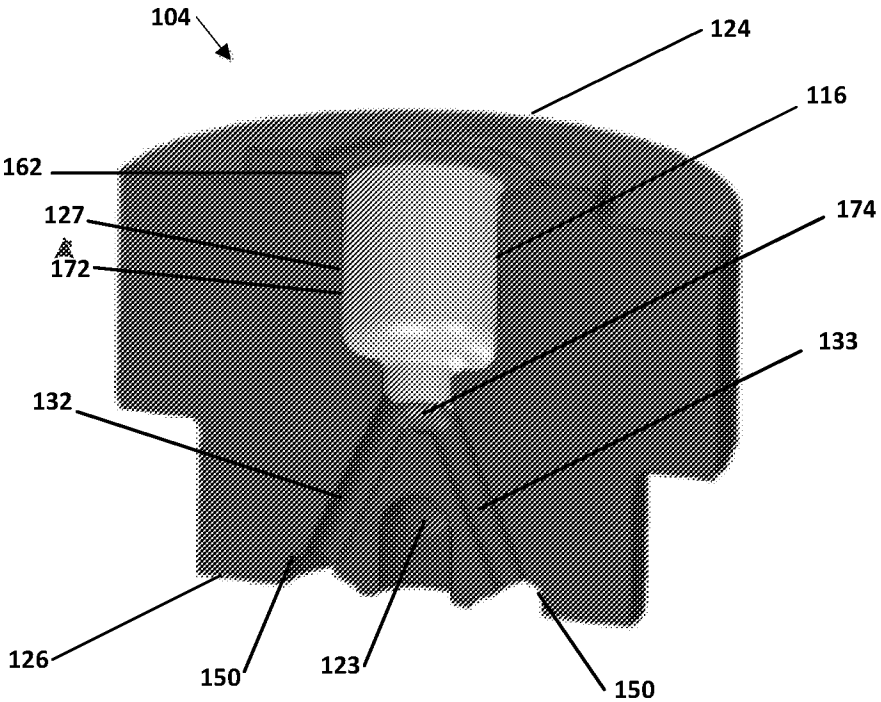
FIG. 2B is a cross-sectional view of a first insert/check valve body of the pumping element of FIGS. 1A and 1B according to an exemplary embodiment of the present disclosure.
Figure 2A:
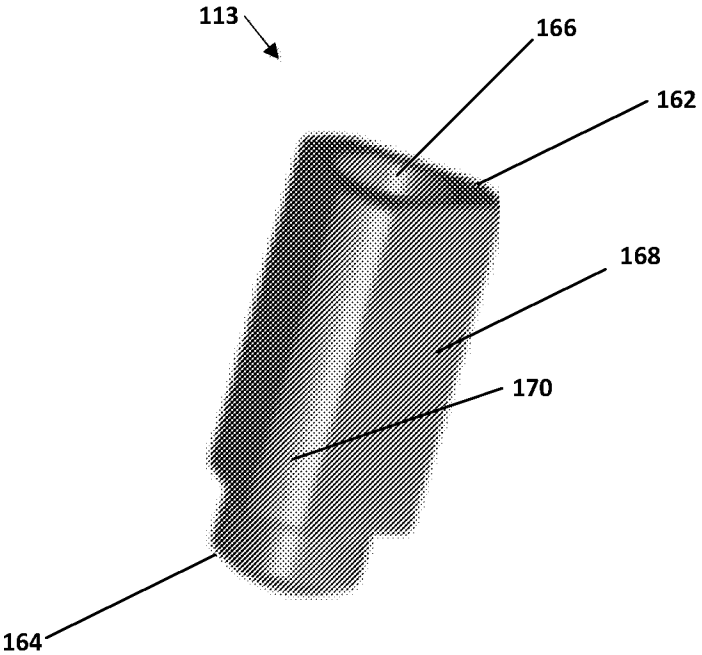
FIG. 2A is an outlet check valve plunger of the pumping element of FIGS. 1A and 1B according to an exemplary embodiment of the present disclosure.
Figure 3B:
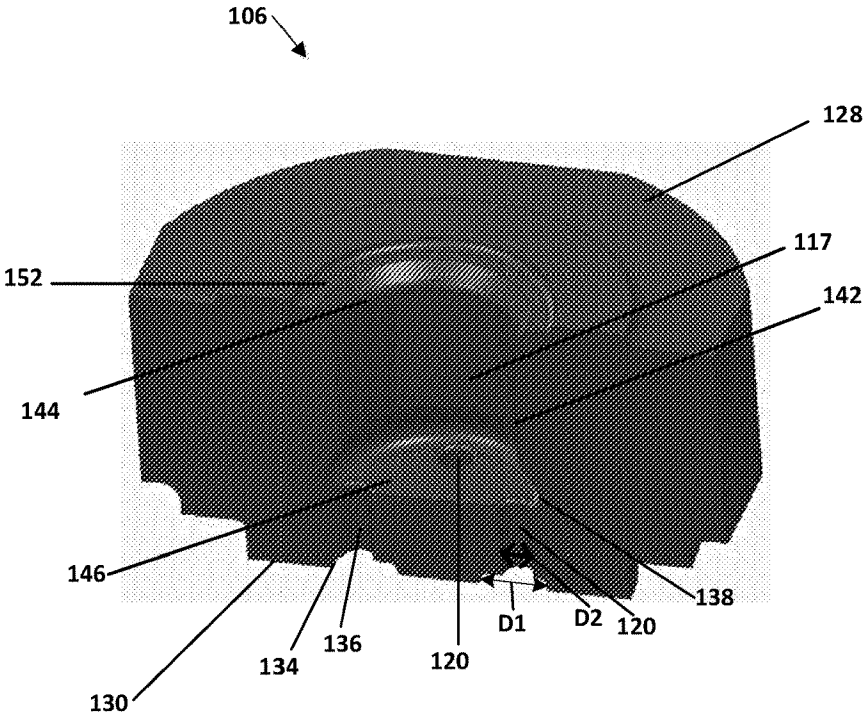
FIG. 3B is a cross-sectional view of a second insert/check valve body of the pumping element of FIGS. 1A and 1B according to an exemplary embodiment of the present disclosure.
Figure 3A:
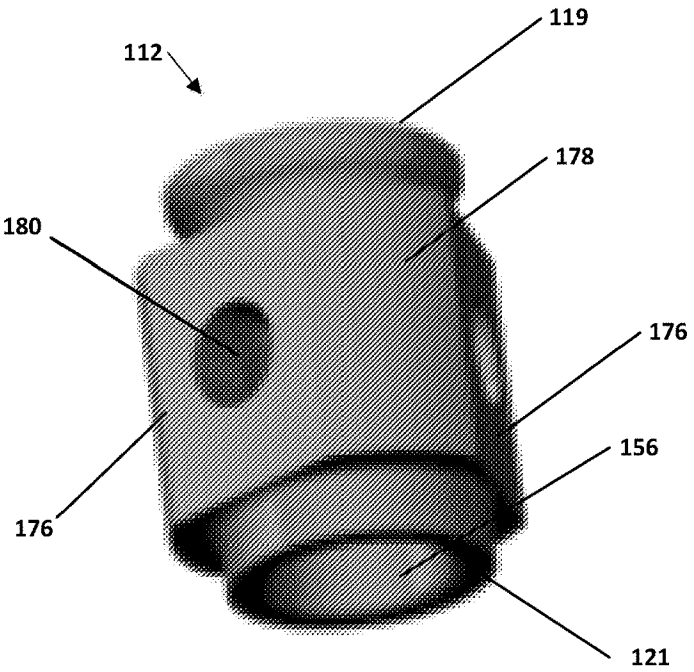
FIG. 3A is an inlet check valve plunger of the pumping element of FIGS. 1A and 1B according to an exemplary embodiment of the present disclosure.

FIGS. 1A and 1B depict cross-sectional views of pumping element 100. Pumping element 100 generally includes a body 101 having an upper/fuel inlet chamber 107, a lower chamber 108, a first fuel inlet port 122 and a second fuel inlet port 123, wherein the first and second fuel inlet ports are each in flow communication with fuel inlet chamber 107. Fuel inlet chamber 107 includes a check valve (CV) assembly 102 having a first insert/check valve body 104 and a second insert/check valve body 106. Lower chamber 108 includes a barrel bore 109 including a pumping plunger 110, wherein barrel bore 109 and pumping plunger 110 cooperate with second insert 106 to form a pumping chamber 111.

Referring to the disclosed embodiment of FIGS. 1A-2B, first insert 104 includes a first end 124, a second end 126, and a central bore 116, wherein central bore 116 includes an annular wall 127 and extends downwardly from first end 124 towards second end 126. First insert 104 further includes an outlet check valve plunger 113, wherein outlet check valve plunger 113 is received by central bore 116 of first insert 104. Outlet check valve plunger 113 includes a first end 162, a second end 164, and a central bore 166, wherein central bore 166 extends downwardly from first end 162 towards second end 164. Outlet check valve plunger 113 further includes outlet check valve spring 115, wherein outlet check valve spring 115 is received by central bore 166 such that outlet check valve spring 115 is disposed within outlet check valve plunger 113. Outlet check valve spring 115 exerts a constant spring force that functions to bias outlet check valve plunger 113 in a downward or closed position until such time that pressurized outlet fuel exiting pumping element 100 builds a sufficiently high fuel pressure within fuel inlet chamber 107 to overcome the constant downward biasing spring force of outlet spring 115. When the biasing spring force of outlet check valve spring 115 is overcome by a sufficiently high outlet fuel pressure, outlet check valve plunger 113 moves to an upward or opened position in response to the increase in outlet fuel pressure within fuel inlet chamber 107. Outlet check valve plunger 113 further includes one or more planar surfaces 168 and one or more curved surfaces 170, wherein the one or more curved surfaces 170 are in direct contact with annular wall 127 of central bore 116 and the one or more planar surfaces 168 each cooperate with annular wall 127 to form one or more fuel flow channels 172 each having a longitudinal axis (not shown).

In one embodiment of the present disclosure, first insert 104 further includes at least a first angled passage 132 and a second angled passage 133 wherein first angled passage 132 and second angled passage 133 converge. Additionally, each angled passage may extend upwardly toward outlet check valve plunger 113 and inwardly from second end 126 of first insert 104 towards a central longitudinal axis 140 of pumping element 100. According to the disclosed embodiment, first angled passage 132 and second angled passage 133 converge at central longitudinal axis 140 such that a convergence section 174 is formed by the first and second angled passages. Convergence section 174 is located directly adjacent central bore 116 of first insert 104. Moreover, when outlet check valve plunger 113 is in a closed position convergence section 174 is adjacent second end 164 of outlet check valve plunger 113. Further, when outlet check valve plunger 113 is in an opened position a flow path between convergence section 174 and central bore 116 is created such that central bore 116, convergence section 174, first angled passage 132 and second angled passage 133 all cooperate to enable second insert 106 to be in flow communication with first insert 104. In the disclosed embodiment, second fuel inlet port 123 is positioned intermediate the converging first and second angled passages. Second end 126 of first insert 104 includes an annular recess 150. First angled passage 132 extends upwardly and inwardly from a passage opening formed within a first section of annular recess 150 and second angled passage 133 extends upwardly and inwardly from a passage opening formed within a second section of annular recess 150.

Referring to the disclosed embodiment of FIGS. 1A-3B, second insert 106 includes a first end 128, a second end 130, and a central bore 117. Central bore 117 includes an annular wall 142 and extends downwardly from first end 128 towards second end 130. Second insert 106 further includes an inlet check valve plunger 112, wherein inlet check valve plunger 112 is received by central bore 117 of second insert 106. Inlet check valve plunger 112 includes a first end 119, a second end 121, and a central bore 156, wherein central bore 156 extends upwardly from second end 121 towards first end 119. Inlet check valve plunger 112 further includes inlet check valve spring 114, wherein inlet check valve spring 114 is received by central bore 156 such that inlet check valve spring 114 is disposed within inlet check valve plunger 112. Inlet check valve spring 114 exerts a constant upward spring force that functions to bias inlet check valve plunger in an upward or closed position until such time that pressurized inlet fuel entering pumping element 100 attains a sufficiently high fuel pressure within fuel inlet chamber 107 to overcome the constant upward biasing spring force of inlet check valve spring 114. When the constant upward biasing spring force of inlet check valve spring 114 is overcome by sufficiently high inlet fuel pressure, inlet check valve plunger 112 moves to a downward or opened position in response to the increase in inlet fuel pressure within fuel inlet chamber 107. Inlet check valve plunger 112 further includes one or more planar surfaces 176 each having a vent-hole 180 and one or more curve surfaces 178, wherein the one or more curved surfaces 178 are in direct contact with annular wall 142 of central bore 117. One or more planar surfaces 176 each cooperate with annular wall 142 to form one or more fuel flow channels 182 each having a longitudinal axis. Vent-hole 180 enables pressure equalization within central bore 117 by venting pressure build-up within central bore 156 of inlet check valve plunger 112. Vent-hole 180 enables venting of pressure build-up by providing a pressure flow path such that elevated pressures within central bore 156 of inlet check valve plunger 112 can flow through to one or more of the fuel flow channels 182.

Second insert 106 further includes a plurality of through-holes 120 that extend from second end 130 upwardly along a longitudinal axis of second insert 106. Plurality of through-holes 120 are disposed below and adjacent central bore 117 such that each one of plurality of through-holes 120 extend upwardly and terminate into central bore 117. In one embodiment of the present disclosure, plurality of through-holes 120 may have a first section 134 having a first diameter D1 and a second section 136 having a second diameter D2, wherein first diameter D1 is greater than second diameter D2. The different diameter at first section 134 and second section 136 is because the opening or first section 134 of through-holes 120 may be slightly wider than second section 136 of through-holes 120. The larger diameter of through-holes 120 at first section 134 allows for improved mechanical stress management at the openings and improved flow characteristics of highly pressurized fuel within pumping element 100. In one aspect of this embodiment, second insert 106 includes 6 or fewer through-holes 120, wherein the number of the plurality of through-holes 120 is proportional to the amount of fuel entering and exiting lower chamber 108. According to another embodiment of the present disclosure, central bore 117 may include an annular shoulder 138 and second section 136 of plurality of through-holes 120 may be disposed annularly within annular shoulder 138. Annular wall 142 of central bore 117 may have a first diameter and annular shoulder 138 may project outwardly radially relative to annular wall 142, wherein the outward radial projection of annular shoulder 138 causes central bore 117 to have a second diameter that is greater than the first diameter. Second insert 106 includes an annular recess 152 wherein annular recess 150 of first insert 104 cooperates with annular recess 152 to form an annular passage 158.

Inlet check valve plunger 112 is reciprocally moveable within central bore 117 of second insert 106 wherein movement longitudinally downwardly within central bore 117 causes inlet check valve plunger 112 to move away from first insert 104 in abutting engagement with second end 146 of central bore 117. Thus inlet check valve plunger 112 is in an opened position when inlet check valve plunger 112 moves downwardly or away from first insert 104 and abuts or contacts second end 146. When inlet check valve plunger 112 is in an opened position fuel entering fuel inlet chamber 107 via second fuel inlet port 123 flows to lower chamber 108 via one or more fuel flow channels 182. Inlet fuel enters upper chamber 107 at a filling pressure of approximately 150 pounds per square inch (psi). From the opened position when abutting or in contact with second end 146 of central bore 117, inlet check valve plunger 112 may then move longitudinally upwardly within central bore 117 toward first insert 104. In this manner, inlet check valve plunger 112 transitions from the opened position to the closed position where it is in sealing engagement with second end 126 of first insert 104. As described in further detail below, the sealing engagement formed by first end 119 of inlet check valve plunger 112 abutting or contacting second end 126 of first insert 104 prevents the flow of inlet fuel into central bore 117 and lower chamber 108. Furthermore, movement by inlet check valve plunger 112 from the downward opened position to the upward closed position defines a stroke gap between second end 121 of inlet check valve plunger 112 and second end 146 of central bore 117. In one embodiment, the stroke gap is at least 0.4 mm.

Referring to the disclosed embodiment of FIGS. 1A-3B, as described in further detail below, during operation of pumping element 100, fuel pressurized at approximately 150 psi enters pumping element 100 initially via first fuel inlet port 122. The pressurized fuel proceeds to at least partially fill fuel inlet chamber 107 before flowing into the t-shaped passage of fuel inlet passage 160. Upon entry in fuel inlet passage 160, the pressurized fuel subsequently proceeds to flow toward second fuel inlet port 123. Fuel inlet passage 160 is a generally t-shape passage that directs the flow of pressurized inlet fuel toward second fuel inlet port 123. Fuel inlet passage 160 includes a latitudinal portion and a longitudinal portion wherein second fuel inlet port 123 is disposed within the longitudinal portion of fuel inlet passage 160. The pressurized fuel initially entering fuel inlet chamber 107 via first fuel inlet port 122 ultimately proceeds to fill central bore 117 and further flows longitudinally downwardly toward lower chamber 108.

As indicated above, lower chamber 108 includes pumping plunger 110, pumping chamber 111 and barrel bore 109. Pumping plunger 110 is positioned within barrel bore 109 of lower chamber 108 wherein pumping chamber 111 is defined by a pressurized volume between second end 130 of second insert 106 and pumping plunger 110. Pumping plunger 110 is further positioned for reciprocal movement in a longitudinal or axial direction within barrel bore 109. As described in further detail herein below, during operation of pumping element 100, pumping plunger 110 moves between an extended or upward position during a pressurization stroke and a retracted or downward position during a filling stroke. When pumping plunger 110 is in the retracted position (away from second insert 106), inlet check valve plunger 112 is in the opened position allowing for pressurized inlet fuel from the one or more fuel inlet ports to fill pumping chamber 111. Inlet fuel present in pumping chamber 111 becomes highly pressurized as pumping plunger 110 moves from the retracted position to the extended position (toward second insert 106).

When pumping plunger 110 moves to the extended or upward position a pressurization stroke occurs, this causes a sudden and momentary spike in fuel pressure. The pressurization stroke causes the pressure of the fuel (later described as high-pressure outlet fuel) to be sufficiently high, for example, between 30 and 2500 bar or more, thereby causing inlet check valve plunger 112 to close, and fuel flow to be reversed. Thus, the pressurized inlet fuel that initially flowed through second insert 106 via central bore 117 to fill pumping chamber 111 later reverses flow direction (becoming high-pressure outlet fuel) and exits pumping chamber 111 in response to pumping plunger 110 moving from the retracted position to the extended position. Thus, inlet check valve plunger 112 moves to the closed position in response to the upward biasing force of inlet check valve spring 114 in cooperation with the reversal of fuel flow of the high pressure outlet fuel exiting pumping chamber 111. As described below, in one embodiment of the present disclosure the sufficiently high outlet fuel pressure caused by the pressurization stroke further causes outlet check valve plunger 113 to move to the opened position thereby allowing the highly pressurized outlet fuel to exit pumping element 100 via at least first fuel outlet 184.

Pumping element 100 presented herein may be arranged within a fuel pump (not shown) and configured to facilitate the pumping of fuel into a common fuel rail (not shown) of the fuel system of an internal combustion engine (not shown) wherein the common fuel rail supplies pressurized fuel to one or more fuel injectors (not shown) during operation of the internal combustion engine. Exemplary fuel pumps, various components of the internal combustion engine, as well as mechanical and electrical operation of exemplary fuel systems are described in the U.S. Patent Application Publication No. 2014/0193281 A1 published on 10 Jul. 2014, the entire disclosure of which is hereby expressly incorporated herein by reference. Upon review of U.S. Patent Application Publication No. 2014/0193281 A1, those of ordinary skill in the art will understand the description of the internal combustion engine and will further understand fuel system component functionality provided therein. Moreover, those of ordinary skill in the art will further understand how pumping element 100 may facilitate the pumping of high pressure fuel within one or more of the disclosed exemplary fuel systems provided therein.

Pumping element 100 operates as follows. As described above, during operation of pumping element 100, pumping plunger 110 moves between an extended or upward position during a pressurization stroke and a retracted or downward position during a filling stroke. During the filling stroke and while in the retracted position, fuel pressurized at approximately 150 psi enters fuel inlet chamber 107 of pumping element 100 via first fuel inlet port 122. The pressurized inlet fuel entering pumping element 100 may be characterized as low-pressure fuel when contrasted with the highly pressurized outlet fuel which exits pumping element 100 at a pressure of approximately 33,000 psi. According to one embodiment of the present disclosure, low-pressure inlet fuel flows into first fuel inlet port 122 from, for example, a fuel tank positioned upstream from pumping element 100 wherein the fuel is supplied to pumping element 100 via a pressurized fuel supply line. As low-pressure inlet fuel flows into first fuel inlet port 122 of first insert 104, low-pressure inlet fuel begins to at least partially accumulate within upper chamber 107 wherein the low-pressure fuel proceeds to flow through fuel inlet passage 160 toward second fuel inlet port 123. The low-pressure fuel subsequently proceeds to flow through second fuel inlet port 123 and partially accumulate at first end 119 of inlet check valve plunger 112. The inlet fuel pushes longitudinally downwardly against first end 119 of inlet check valve plunger 112 with a pressure that is sufficiently high to overcome the upward biasing spring force of inlet check valve spring 114. The pressure of the inlet fuel is enough to compress inlet check valve spring 114 by an amount sufficient to cause inlet check valve plunger 112 to move to the opened position in direct contact with second end 146 of central bore 117. According to the disclosed embodiment, compression of inlet check valve spring 114 causes inlet check valve plunger 112 to move longitudinally downwardly by a distance of at least 0.4 mm (inlet check valve plunger stroke gap 148).

According to the present disclosure, and as described above, inlet check valve plunger 112 has an opened position which permits fuel flow from the one or more fuel inlet ports to enter central bore 117 of second insert 106. Inlet check valve plunger 112 also has a closed position which prevents fuel flow from the one or more fuel inlet ports to enter central bore 117. Additionally, inlet check valve plunger 112 is reciprocally moveable within central bore 117 such that inlet check valve plunger 112 is opened when in a downward position relative to central bore 117 and is closed when in an upward position relative to central bore 117. As low-pressure inlet fuel proceeds to exert a downward pressure on inlet check valve plunger 112, inlet check valve plunger 112 proceeds to move toward pumping chamber 111. Thus, inlet check valve plunger 112 moves downwardly or longitudinally within central bore 117 to the opened position thereby by allowing low-pressure inlet fuel to flow through central bore 117 via one or more inlet check valve fuel flow channels 182. Low-pressure fuel proceeds to flow toward and ultimately through one or more of the plurality of through-holes 120 and into pumping chamber 111, wherein the low-pressure accumulates and fills the volume of space that defines pumping chamber 111.

As described above, during operation of pumping element 100, subsequent to the filling stroke, pumping plunger 110 moves to an extended or upward position which defines a pressurization stroke. During the pressurization stroke and as pumping plunger 110 moves to the extended position, an instantaneous spike in fuel pressure occurs causing the low-pressure inlet fuel to reverse direction thereby becoming high-pressure outlet fuel having a pressure of approximately 33,000 psi. The high-pressure fuel flowing in the reversed direction proceeds to move upwardly or longitudinally away from pumping plunger 110 thereby exiting pumping chamber 111. Additionally, as described above, inlet check valve plunger 112 has a closed position which prevents fuel flow from the one or more fuel inlet ports to enter central bore 117. According to the disclosed embodiment, inlet check valve plunger 112 moves to the closed position in response to the reversal of fuel flow direction cooperating with the longitudinally upward biasing spring force of inlet check valve spring 114 in combination with high-pressure outlet fuel exiting pumping chamber 111. As high-pressure outlet fuel exits pumping chamber 111, inlet check valve plunger 112 rapidly moves to the closed position whereby first end 119 of inlet check valve plunger 112 sealingly engages second end 126 of first insert 104. The abrupt sealing engagement of first end 119 in abutting or direct contact with second end 126 prevents any slip-flow of outlet fuel wherein slip-flow is defined by high-pressure outlet fuel escaping back through second fuel inlet port 123 during the pressurization stroke of pumping element 110. Any amount of slip-flow results in decreased pumping efficiency of pumping element 100. Accordingly, the disclosed embodiment of pumping element 100 provides for reduced slip-flow of high-pressure outlet fuel thereby increasing the pumping efficiency of pumping element 100.

Referring again to the flow of high-pressure outlet fuel, according to the disclosed embodiment, as outlet fuel exits pumping chamber 111 the outlet fuel proceeds to flow longitudinally upwardly through one or more of the plurality of through-holes 120 away from pumping plunger 110. The high-pressure outlet fuel proceeds to flow through central bore 117 via the one or more fuel flow channels 182 and longitudinally upwardly toward first insert 104. The high-pressure outlet fuel proceeds to accumulate and at least partially fill annular passage 158, wherein the outlet fuel proceeds to flow longitudinally upwardly toward convergence section 174 via at least one of first angled passage 132 and second angled passage 133. The high-pressure outlet fuel accumulates at convergence section 174 wherein the high outlet fuel pressure pushes longitudinally upwardly against second end 164 of outlet check valve plunger with a pressure that is sufficiently high to overcome the downward biasing spring force of outlet check valve spring 115. The high-pressure outlet fuel compresses outlet check valve spring 114 by an amount sufficient to cause outlet check valve plunger 113 to move to the opened position and away from convergence section 174.

According to the present disclosure, and as described above, outlet check valve plunger 113 has an opened position which permits the flow of high-pressure outlet fuel from, for example, convergence section 174 to exit pumping element 100. Outlet check valve plunger 113 also has a closed position which prevents the flow of high-pressure outlet fuel from at least convergence section 174 to exit pumping element 100. Additionally, outlet check valve plunger 113 is reciprocally moveable within central bore 116 such that outlet check valve plunger 113 is opened when in an upward position relative to central bore 116 and is closed when in a downward position relative to central bore 116. As high-pressure outlet fuel proceeds to exert an upward longitudinal pressure on outlet check valve plunger 113, outlet check valve plunger 113 proceeds to move away from convergence section 174 to the opened position. Thus, outlet check valve plunger 113 moves longitudinally upwardly within central bore 116 thereby by allowing high-pressure outlet fuel to flow through central bore 116 via one or more outlet check valve fuel flow channels 172. High-pressure fuel proceeds to flow away from convergence section 174 toward and ultimately through first fuel outlet 184 whereby the high-pressure fuel proceeds upstream away from pumping element 100 toward, for example, a common fuel rail or fuel accumulator within a fuel system of an internal combustion engine. According to the present disclosure, once high-pressure fuel exits pumping element 100, pumping plunger 110 completes the pressurization stroke and thus moves from the extended position to the retracted position to begin a subsequent pumping operation.

Figure 4B:
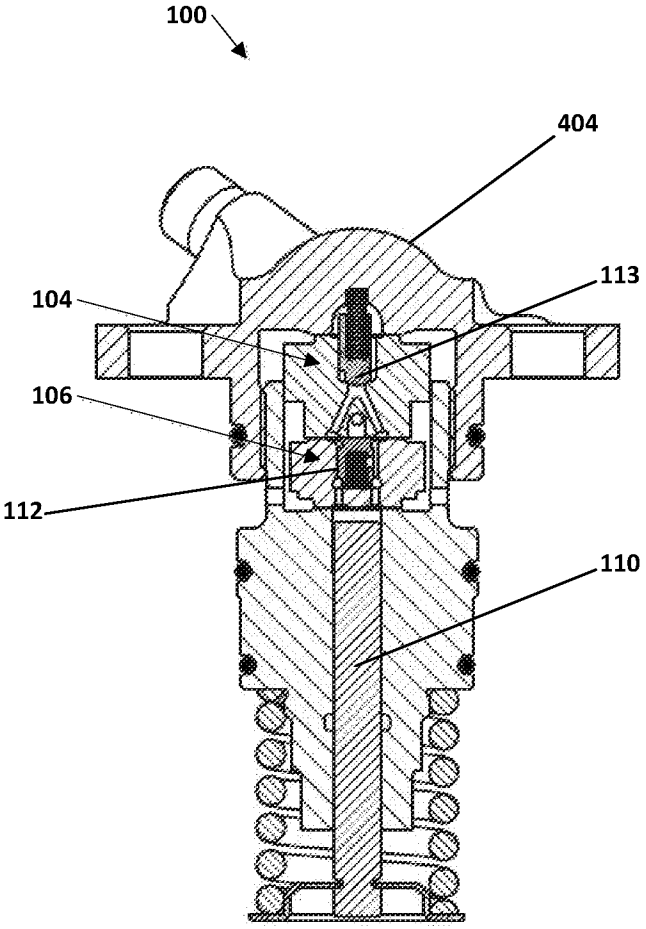
FIG. 4B is a cross-sectional view of a pumping element of FIGS. 1A and 1B including a side-out fuel outlet head assembly according to an exemplary embodiment of the present disclosure.
Figure 4A:
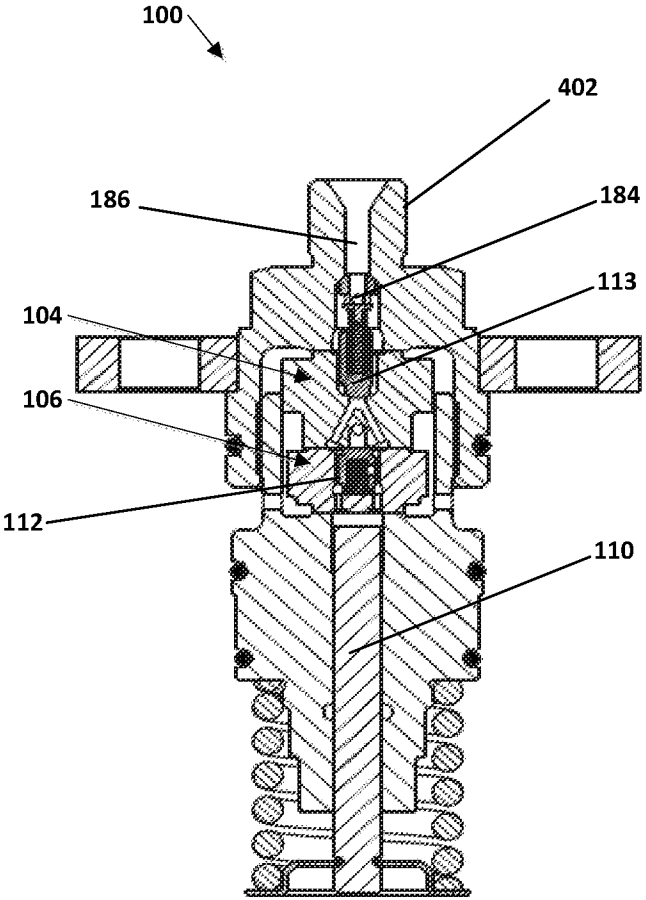
FIG. 4A is a cross-sectional view of a pumping element of FIGS. 1A and 1B including a top-out fuel outlet head assembly according to an exemplary embodiment of the present disclosure.

Referring to the disclosed embodiment of FIG. 4A, pumping element 100 may include a top-out head assembly 402 mounted generally above upper/fuel inlet chamber 107 wherein top-out head assembly 402 includes a second fuel outlet port 186 disposed longitudinally above upper chamber 107. Top-out head assembly 402 facilitates delivery of high-pressure outlet fuel from pumping element 100 in response to at least: the pressurization stroke of pumping plunger 110, inlet check valve plunger 112 moving to the closed position, and outlet check valve plunger 113 moving to the opened position. Referring to the disclosed embodiment of FIG. 4B, pumping element 100 may include a side-out head assembly 404 mounted generally above upper/fuel inlet chamber 107 wherein side-out head assembly 404 includes a second fuel outlet port (not shown) disposed at an angle relative to upper chamber 107. In one aspect of this embodiment, second fuel outlet port (not shown) of side-out head assembly 404 is disposed at approximately a 45-degree angle relative to upper chamber 107. Side-out head assembly 404 facilitates delivery of high-pressure outlet fuel from pumping element 100 in response to at least: the pressurization stroke of pumping plunger 110, inlet check valve plunger 112 moving to the closed position and, outlet check valve plunger 113 moving to the opened position. Top-out head assembly 402 and side-out head assembly 404 each provide a flow communication path that enables outlet flow of high-pressure outlet fuel from pumping chamber 110 to exit pumping element 100.

According to the various embodiments of the present disclosure, after high-pressure outlet fuel exits pumping element 100, high-pressure fuel may travel to, for example, a fuel rail or accumulator (not shown). In one embodiment of the present disclosure, a control system of internal combustion engine, which is not shown, operates one or more fuel injectors in a manner known to those skilled in the art wherein the control system causes the one or more fuel injectors to provide fuel to combustion chambers within an internal combustion engine. In one aspect of this embodiment, a pressure relief valve may relieve pressure in, for example, a fuel accumulator when the high-pressure outlet fuel is above a predetermined level. In a variant of this aspect, the fuel released during the opening of the pressure relief, i.e. relieved fuel, may be returned to, for example, a fuel tank within the fuel system of an internal combustion engine wherein the relieved/return fuel may be resupplied to pumping element 100 as low-pressure inlet fuel.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

The invention claimed is:

1. A pumping element comprising:

a check valve having a first insert including at least one angled passage and a second insert including a central bore and an inlet check valve plunger disposed in the central bore, the first insert having a first end and a second end opposite the first end thereof, and the inlet check valve plunger having a first end, a second end opposite the first end thereof, and one or more planar surfaces defining together with the central bore one or more fuel flow channels through which fuel is allowed to flow to the first insert from the second insert when the first end of the inlet check valve plunger is in contact with the second end of the first insert, the one or more planar surfaces extending longitudinally in the direction of a longitudinal axis of the check valve; and a pumping chamber positioned upstream of a most upstream end of the second insert relative to a flow of fuel away from the pumping chamber, wherein the second insert of the check valve is disposed adjacent the pumping chamber, the second insert including a plurality of through-holes configured to allow fuel to enter and exit the pumping chamber;

wherein a fuel inlet passage extends latitudinally within the first insert so as to allow inlet fuel to flow inwardly toward a central longitudinal axis of the first insert and downwardly from the second end of the first insert through the one or more fuel flow channels and into the pumping chamber, such that outlet fuel from the pumping chamber flows through the one or more fuel flow channels and upwardly and inwardly from the second end of the first insert toward the central longitudinal axis through the at least one angled passage.

2. The pumping element of claim 1, wherein the second insert of the check valve includes a first end and a second end, the first end of the second insert being downstream of the second end of the second insert relative to a flow of fuel away from the pumping chamber, wherein the central bore extends from the first end of the second insert upstream along the longitudinal axis of the check valve relative to a flow of fuel away from the pumping chamber.

3. The pumping element of claim 2, wherein the plurality of through-holes each include a first end and a second end, the plurality of through-holes extending downstream from the second end of the second insert relative to a flow of fuel away from the pumping chamber and terminating at the central bore.

4. The pumping element of claim 3, wherein each one of the plurality of through-holes includes a first diameter at the first end of the one of the plurality of through-holes adjacent the second end of the second insert and a second diameter at the second end of the one of the plurality of through-holes adjacent the central bore, wherein the first diameter is greater than the second diameter.

5. The pumping element of claim 1, wherein the central bore includes an annular shoulder and the plurality of through-holes are disposed radially inward of the annular shoulder.

6. The pumping element of claim 5, wherein the central bore includes an annular wall having a first diameter and the annular shoulder, positioned upstream of the annular wall relative to a flow of fuel away from the pumping chamber, projects outwardly radially relative to the annular wall, wherein the outward radial projection of the annular shoulder forms a second diameter of the central bore that is greater than the first diameter.

7. The pumping element of claim 1, wherein the number of the plurality of through-holes is proportional to an amount of fuel entering and exiting the pumping chamber.

8. The pumping element of claim 1, wherein the inlet check valve plunger is reciprocally moveable in the central bore between an opened position and a closed position.

9. The pumping element of claim 1, wherein the first end of the first insert is downstream of the second end of the first insert relative to a flow of fuel away from the pumping chamber, and, wherein the inlet check valve plunger in the closed position is in sealing engagement with the second end of the first insert.

10. The pumping element of claim 9, wherein the sealing engagement prevents fuel flow into the central bore and into the pumping chamber.

11. A pumping element comprising:

a body having an upper chamber, a lower chamber and at least one fuel inlet port disposed in the upper chamber;

a first check valve body and a second check valve body, wherein the first and second check valve bodies are entirely disposed in the upper chamber, and the first check valve body includes an outlet check valve plunger, at least one angled passage, a first end, and a second end opposite the first end thereof;

an inlet check valve plunger disposed longitudinally within at least a portion the second check valve body in the upper chamber and a pumping plunger disposed longitudinally in the lower chamber, the inlet check valve plunger having an opened position and a closed position, wherein the opened position permits fuel from the at least one fuel inlet port to fill the lower chamber, and the inlet check valve plunger further having a first end, a second end opposite the first end thereof, and one or more planar surfaces defining together with the central bore one or more fuel flow channels through which fuel is allowed to flow to the first check valve body from the second check valve body when the first end of the inlet check valve plunger is in contact with the second end of the first check valve body when the inlet check valve plunger is in the closed position, the one or more planar surfaces extending longitudinally in the direction of a longitudinal axis of the check valve; and a biasing member, at least a portion of the biasing member disposed longitudinally in the inlet check valve plunger, wherein the pumping plunger is reciprocally moveable in the lower chamber such that movement of the pumping plunger toward the upper chamber causes the inlet check valve plunger to move to the closed position and the outlet check valve permits fuel to exit the pumping element; and wherein a fuel inlet passage extends latitudinally within the first check valve so as to allow inlet fuel to flow inwardly toward a central longitudinal axis of the first check valve and downwardly from the second end of the first check valve through the one or more fuel flow channels and into the pumping chamber, such that outlet fuel from the pumping chamber flows through the one or more fuel flow channels and upwardly and inwardly from the second end of the first check valve toward the central longitudinal axis through the at least one angled passage.

12. The pumping element of claim 11, wherein the inlet check valve plunger includes a central bore and a spring disposed therein, and the inlet check valve plunger moves to the closed position in response to a biasing force of the spring in cooperation with a reversal of fuel flow.

13. The pumping element of claim 11, wherein a first fuel inlet port is disposed in the upper chamber and a second fuel inlet port is disposed in the first check valve body.

14. The pumping element of claim 13, wherein the first check valve body includes a first angled passage and a second angled passage wherein the first angled passage and the second angled passage converge, and the second fuel inlet port is disposed between the first angled passage and the second angled passage.

15. The pumping element of claim 11, wherein the first end of the first check valve body includes a central bore that receives the outlet check valve plunger and the second end of the first check valve body includes an annular recess.

16. The pumping element of claim 15, wherein the second check valve body includes a first portion and a second portion, wherein the first portion includes a central bore which receives the inlet check valve plunger, the central bore having an opening with an annular recess at a first end of the second check valve body.

17. The pumping element of claim 16, wherein the annular recess of the first check valve body and the annular recess of the second check valve body cooperate to form an annular passage between the first check valve body and the second check valve body.

18. The pumping element of claim 11, wherein the outlet check valve responds to movement of the pumping plunger toward the upper chamber by delivering fuel from the pumping element and movement of the pumping plunger away from the upper chamber by preventing delivery of fuel from the pumping element.

19. The pumping element of claim 18, wherein during fuel delivery by the pumping element, fuel travels from the lower chamber and through the first check valve body via the at least one angled passage.

20. The pumping element of claim 11, further including a head assembly mounted to the upper chamber wherein the head assembly includes a fuel outlet port configured to deliver fuel from the pumping element in response to the inlet check valve plunger being in the closed position.

21. The pumping element of claim 20, wherein at least a portion of the fuel outlet port includes a surface disposed at an angle relative to a longitudinal axis of the upper chamber.

22. A pumping element comprising:

a pumping chamber; and a check valve assembly having a first insert including a passage in flow communication with a fuel outlet and a second insert being disposed adjacent the pumping chamber, the second insert including a bore in flow communication with a fuel inlet, a plurality of through holes in flow communication with the pumping chamber, and an inlet check valve plunger entirely disposed in the bore for movement between an opened position wherein fuel from the fuel inlet flows past the inlet check valve plunger via one or more fuel flow channels defined between the bore and one or more planar surfaces of the inlet check valve plunger and flows through the plurality of through holes to the pumping chamber and a closed position wherein a first side of the inlet check valve plunger contacts a second side of the first insert such that fuel from the pumping chamber flows through the plurality of through holes past the inlet check valve plunger via the one or more fuel flow channels to the passage of the first insert, at least a portion of the inlet check valve plunger abutting the first insert in the closed position, the one or more planar surfaces extending longitudinally in the direction of a longitudinal axis of the check valve;

wherein fluid is allowed to flow to the first insert from the second insert when the plunger abuts the first insert in the closed position; and wherein a fuel inlet passage extends latitudinally within the first insert so as to allow inlet fuel to flow inwardly toward a central longitudinal axis of the first insert and downwardly from the second end of the first insert through the one or more fuel flow channels and into the pumping chamber, such that outlet fuel from the pumping chamber flows through the one or more fuel flow channels and upwardly and inwardly from the second end of the first insert toward the central longitudinal axis through the at least one angled passage.

23. The pumping element of claim 22, wherein the inlet check valve plunger includes a central bore and a spring disposed therein, and the inlet check valve plunger moves to the closed position in response to a biasing force of the spring in cooperation with a reversal of fuel flow.

24. The pumping element of claim 22, wherein the first insert includes a first end and a second end and, wherein the inlet check valve plunger in the closed position is in sealing engagement with the second end of the first insert, wherein the sealing engagement prevents fuel flow into the pumping chamber.

* * * * *